US008161710B2

(12) United States Patent
Elliott et al.

(10) Patent No.: US 8,161,710 B2
(45) **Date of Patent: *Apr. 24, 2012**

(54) PROJECTILE-RESISTANT WALL STRUCTURE WITH INTERNAL BAG

(75) Inventors: A. Carleton Elliott, Newport Beach, CA (US); Allan J. Swartz, Gardnerville, NV (US); Gregory Kulpa, Tustin, CA (US)

(73) Assignee: Specialty Hardware L.P., Newport Beach, CA (US)

( * ) Notice: Subject to any disclaimer, the term of this patent is extended or adjusted under 35 U.S.C. 154(b) by 269 days.

This patent is subject to a terminal disclaimer.

(21) Appl. No.: 12/644,518

(22) Filed: Dec. 22, 2009

(65) Prior Publication Data

US 2010/0199892 A1 Aug. 12, 2010

Related U.S. Application Data

(63) Continuation-in-part of application No. 11/620,670, filed on Jan. 6, 2007, now Pat. No. 7,637,073.

(60) Provisional application No. 60/766,286, filed on Jan. 8, 2006.

(51) Int. Cl.
*E04B 1/00* (2006.01)
*E04G 21/00* (2006.01)
*E04G 23/00* (2006.01)

(52) U.S. Cl. ..... 52/745.05; 52/202; 89/36.01; 109/49.5

(58) Field of Classification Search ..... 52/202, 52/203; 89/36.02, 36.04, 36.01; 109/49.5, 109/78

See application file for complete search history.

(56) References Cited

U.S. PATENT DOCUMENTS

| | | | | |
|---|---|---|---|---|
| 3,308,004 | A | 3/1967 | Rouault | |
| 3,736,715 | A | 6/1973 | Krumwiede | |
| 3,832,958 | A * | 9/1974 | Hiorth | 109/1 R |
| 4,122,203 | A | 10/1978 | Stahl | |
| 4,147,004 | A | 4/1979 | Day et al. | |
| 4,288,962 | A | 9/1981 | Kavanaugh | |
| 4,822,657 | A * | 4/1989 | Simpson | 428/69 |
| 5,724,783 | A | 3/1998 | Mandish | |

(Continued)

OTHER PUBLICATIONS

Young, Lee W. (Authorized Officer of PCT/ISA/US), PCT Notification of Transmittal of the International Search Report and the Written Opinion of the International Searching Authority; PCT International Search Report; and PCT Written Opinion of the International Searching Authority, mailed on Aug. 1, 2008, in International Application No. PCT/US07/80074, 9 pages total.

*Primary Examiner* — William Gilbert
*Assistant Examiner* — Chi Nguyen
(74) *Attorney, Agent, or Firm* — Jerry Turner Sewell

(57) ABSTRACT

A wall structure and a method for constructing the wall of a building provide protection for inhabitants of the building against ballistic projectiles impacting the wall. The wall structure includes an outer panel and an inner panel. The inner panel is a composite structure that includes a metal sheet having a first face attached to a wallboard panel. Preferably, a sheet of self-healing material is attached to a second face of the metal sheet. A cavity formed between the outer and inner panels is filled with sand or another granular material. A flexible sheet suspended in the cavity provides additional protection. Preferably, a sheet of woven para-aramid fiber such as Kevlar® brand fiber is loosely attached to the flexible sheet to provide further protection.

21 Claims, 15 Drawing Sheets

U.S. PATENT DOCUMENTS 5,729,936 A 3/1998 Maxwell
5,758,463 A 6/1998 Mancini, Jr.
5,768,841 A 6/1998 Swartz et al.
5,819,469 A 10/1998 Hsu
5,939,658 A * 8/1999 Muller ..... 89/36.04
6,463,702 B1 10/2002 Weaver et al.
6,510,667 B1 1/2003 Cottier et al.
6,622,452 B2 9/2003 Alvaro
6,694,694 B2 2/2004 Zeeff
6,901,713 B2 6/2005 Axsom
7,331,270 B2 * 2/2008 Booher ..... 89/36.02
7,637,073 B2 * 12/2009 Elliott et al. ..... 52/745.05
2002/0129574 A1 9/2002 Newhouse et al.
2005/0086905 A1 4/2005 Ralph et al.
2006/0065111 A1 3/2006 Henry
2006/0248827 A1 11/2006 Meeker
2007/0224401 A1 9/2007 Telander

* cited by examiner

PROJECTILE-RESISTANT WALL STRUCTURE WITH INTERNAL BAG

RELATED APPLICATIONS

The present application is a continuation-in-part application of U.S. patent application Ser. No. 11/620,670, filed on Jan. 6, 2007, and issuing on Dec. 29, 2009, as U.S. Pat. No. 7,637,073, which claims the benefit of priority under 35 U.S.C. §119(e) to U.S. Provisional Application No. 60/766,286, filed on Jan. 8, 2006.

BACKGROUND OF THE INVENTION

1. Field of the Invention

The description and claims in this application related to wall structures and methods of making wall structures, which provide protection against ballistic devices such as projectiles from pistols, rifles and machine guns.

2. Description of the Related Art

The walls of conventional buildings generally do not provide significant safety from bullets shot from handguns, rifles and machine guns. In particular, although the relatively thin exterior and interior panels of a conventional building may reduce the velocity of bullets, the bullets may penetrate both panels with sufficient velocity remaining to harm or kill an occupant of the building. Fortress-like structures may be built having hardened walls of steel or reinforced concrete; however, such construction is quite expensive. Furthermore, such construction requires the time-consuming transportation of construction materials and heavy construction equipment, and then requires a considerable amount of time to erect. Thus, for example, when a military force enters an area subject to live fire from enemy forces, the military personnel must rely on existing unreinforced structures or portable structures such as tents, none of which provide adequate protection from bullets.

SUMMARY OF THE INVENTION

In view of the foregoing, a need exists for buildings which can be quickly constructed using conventional techniques and using readily transportable materials.

An aspect of an embodiment disclosed herein is a wall system comprising a lower horizontal member, an upper horizontal member, and a plurality of spaced apart vertical supports positioned between the lower horizontal member and the upper horizontal member. Each vertical support has a thickness between a respective first side and a respective second side. A first panel is mounted to the respective first sides of at least two of the vertical supports, and a second panel is mounted to the respective second sides of the at least two of the vertical supports to form a cavity bounded by the first panel and the second panel and bounded by the at least two of the vertical supports. At least one of the first panel and the second panel comprises a sheet of construction material, and a metallic sheet secured to the sheet of construction material. A granular filler material substantially fills the cavity between the lower support member and the upper support member.

In certain embodiments, the granular material comprises a stony material. For example, the stony material comprises sand in certain embodiments. In certain embodiments, a flexible sheet (e.g., a rubber sheet) is suspended from the upper support member in a position between the first panel and the second panel. The flexible sheet has a first face and a second face. A first portion of the granular filler material is positioned between the first face of the flexible sheet and the first panel, and a second portion of the granular filler material is positioned between the second face of the flexible sheet and the second panel. In particular embodiments, a sheet of woven para-aramid fiber (e.g., Kevlar®) is loosely coupled to at least one of the first face and the second face. For example, the woven sheet is secured to the flexible sheet at a plurality of spaced apart locations. In certain embodiments of the wall system, a self-sealing material is positioned on the inside of the metallic sheet to inhibit loss of the granular filler material when the metallic sheet is penetrated by a projectile.

Another aspect of an embodiment disclosed herein is a method of constructing a wall system. The method comprises erecting a plurality of vertical support members between a lower horizontal member and an upper horizontal member to form wall frame having a first side and a second side. The method also comprises mounting a first panel on a first side of the wall frame and mounting a second panel on a second side of the wall frame to form a cavity therebetween. At least one of the first panel and the second panel comprises a sheet of construction material and a sheet of metal adhered to the sheet of construction material. The method further comprises filing the cavity with a granular filler material such that the granular filler material extends from the lower horizontal member to the upper horizontal member.

In certain embodiments of the method, the granular material comprises a stony material, such as, for example, sand. In certain embodiments, the method further comprises suspending a flexible sheet (e.g., a rubber sheet) from the upper horizontal member. The flexible sheet extends from the upper horizontal member to a position proximate the lower horizontal member. In certain embodiments of the method, the flexible sheet is suspended from the upper horizontal member prior to filling the cavity with the granular filler material. In accordance with one embodiment of the method, the flexible sheet is mounted with a first portion of the granular filler material between the flexible sheet and the first panel and with a second portion of the granular filler material between the flexible sheet and the second panel. In accordance with another embodiment of the method, the first portion of granular filler material has a first volume and the second portion of granular filler material has a second volume. In accordance with one embodiment of this aspect of the method, the first volume and the second volume are substantially equal. In certain embodiments of the method, the flexible sheet has a first face and a second face, and a sheet of woven para-aramid fiber (e.g., Kevlar®) is mounted to at least one of the first face or the second face. In certain embodiments, the sheet of woven Kevlar fibers is fastened to the flexible sheet at a plurality of spaced apart locations to provide a loose coupling between the flexible sheet and the Kevlar sheet. In certain embodiments of the method, a self-sealing material is positioned on the inside of the sheet of metal to inhibit loss of the granular filler material when the metallic sheet is penetrated by a projectile.

Another aspect of an embodiment disclosed herein is a method of constructing a protective wall system. The method comprises erecting a plurality of vertical support members between a lower horizontal member and an upper horizontal member to form a wall frame having a first side and a second side. The method further comprises mounting a first panel on a first side of the wall frame and mounting a second panel on a second side of the wall frame to form a cavity therebetween. At least one of the first panel and the second panel comprises a sheet of construction material and a sheet of metal adhered to the sheet of construction material. The method further comprises filing the cavity with a granular filler material.

Certain embodiments of the method include suspending a flexible sheet (e.g., a rubber sheet) within the cavity. Certain embodiments further include loosely mounting a sheet of woven para-aramid fiber (e.g., Kevlar®) to at least one side of the flexible sheet. In certain embodiments of the method, a self-sealing material is positioned on the inside of the sheet of metal to inhibit loss of the granular filler material when the metallic sheet is penetrated by a projectile.

Another aspect in accordance with embodiments disclosed herein is a wall section that comprises a lower horizontal member. At least a first vertical member and a second vertical member have respective lower ends mounted on the lower horizontal member and have respective upper ends. Each of the vertical members has a first side and a second side. An upper horizontal member is mounted on the upper end of the first vertical member and on the upper end of the second vertical member. A first panel is secured to the first side of the first vertical member and to the first side of the second vertical member. A second panel is secured to the second side of the first vertical member and to the second side of the second vertical member. The first panel and the second panel form a cavity bounded by the lower horizontal member, the upper horizontal member, the first vertical member and the second vertical member. At least one of the first panel and the second panel comprises a wallboard sheet and a thin sheet of high strength material attached to and covering at least one side of the wallboard sheet. The wall section further comprises a granular filler material that substantially fills the cavity between the lower horizontal member and the upper horizontal member. In certain embodiments, a flexible sheet is suspended within the cavity. In certain embodiments, a sheet of woven para-aramid fiber (e.g., Kevlar®) is loosely mounted to at least one side of the flexible sheet.

In certain embodiments of the wall section, the granular material comprises a stony material, such as, for example, sand. In certain embodiments of the wall section including a flexible sheet, the flexible sheet is in a plane between and generally parallel to the first panel and the second panel. The flexible sheet has a first face and a second face. A first portion of the granular filler material is positioned between the first face of the flexible sheet and the first panel, and a second portion of the granular filler material is positioned between the second face of the flexible sheet and the second panel. In certain embodiments, the wall system further comprises a sheet of woven para-aramid fiber (e.g., Kevlar®) loosely coupled to at least one of the first face and the second face of the flexible sheet. For example, the woven sheet of Kevlar fiber is secured to the flexible sheet at a plurality of spaced apart locations. In certain embodiments of the wall section, a self-sealing material is positioned on the inside of the sheet of metal to inhibit loss of the granular filler material when the metallic sheet is penetrated by a projectile.

Another aspect in accordance with embodiments disclosed herein is a wall system that includes a lower horizontal member, an upper horizontal member, and a plurality of spaced apart vertical supports positioned between the lower horizontal member and the upper horizontal member. Each vertical support has a thickness between a respective first side and a respective second side. A first panel is mounted to the respective first sides of at least two of the vertical supports and a second panel is mounted to the respective second sides of the at least two of the vertical supports to form a cavity bounded by the first panel and the second panel and bounded by the at least two of the vertical supports. At least one of the first panel and the second panel comprises a sheet of construction material, and a metallic sheet secured to the sheet of construction material. The wall system further includes a bag-like structure secured within the cavity. The bag-like structure comprises at least one sheet of woven, high tensile strength fiber. In certain embodiments, the bag-like structure has a first side facing the first panel and a second side facing the second panel, a first closed edge common to the first side and the second side and a second closed edge common to the first side and the second side, a closed bottom and an open top. The bag-like structure has a flexible cavity defined between the first side and the second side. In certain embodiments, the bag-like structure is supported within the cavity by securing the first and second sides proximate the first closed edge to a first of the vertical supports that bound the cavity and by securing the first and second sides proximate the flexible cavity of the bag-like structure is filled with a selected material. For example, the selected material is advantageously a granular material. The granular material is advantageously a stony material such as sand. The selected material may also be an insulating material such as fiberglass or expanding polyurethane foam. In certain preferred embodiments, the at least one sheet of woven, high tensile strength fiber comprises woven para-aramid fiber. In certain preferred embodiments, the metallic sheet comprises a first face and a second face, wherein the first face of the metallic sheet is secured to the sheet of construction material, and wherein a sheet of self-healing material is positioned on the second face of the metallic sheet.

Another aspect in accordance with embodiments disclosed herein is a method of constructing a wall system. The method includes erecting a plurality of vertical support members between a lower horizontal member and an upper horizontal member to form wall frame having a first side and a second side, and mounting a first panel on a first side of the wall frame and mounting a second panel on a second side of the wall frame to form a plurality of cavities therebetween. At least one of the first panel and the second panel comprises a sheet of construction material and a sheet of metal adhered to the sheet of construction material. The method further includes securing a bag-like structure within the cavity. The bag-like structure comprises at least one sheet of woven, high tensile strength fiber. The bag-like structure has a first side facing the first panel and a second side facing the second panel, a first closed edge common to the first side and the second side and a second closed edge common to the first side and the second side, a closed bottom and an open top. The bag-like structure has a flexible cavity defined between the first side and the second side. In certain embodiments, the method includes filling the flexible cavity of the bag-like structure is filled with a selected material. For example, the selected material is advantageously a granular material. The granular material is advantageously a stony material such as sand. The selected material may also be an insulating material such as fiberglass or expanding polyurethane foam. In certain preferred embodiments, the at least one sheet of woven, high tensile strength fiber comprises woven para-aramid fiber.

Another aspect in accordance with embodiments disclosed herein is a wall section that comprises a lower horizontal member and at least a first vertical member and a second vertical member. Each vertical member comprises a lower end mounted on the lower horizontal member, an upper end, a first side, and a second side. An upper horizontal member is mounted on the upper end of the first vertical member and the upper end of the second vertical member. A first panel is secured to the first side of the first vertical member and to the first side of the second vertical member. A second panel is secured to the second side of the first vertical member and to the second side of the second vertical member. The first panel and the second panel form a cavity bounded by the lower horizontal member, the upper horizontal member, the first vertical member and the second vertical member. At least one of the first panel and the second panel comprises a wallboard sheet, and a thin sheet of high-strength material attached to and covering at least one side of the wallboard sheet. The wall section further comprises a bag-like structure secured within the cavity. The bag-like structure comprises at least one sheet of woven, high tensile strength fiber.

BRIEF DESCRIPTION OF THE DRAWINGS

The foregoing aspects and other aspects of this disclosure are described in detail below in connection with the accompanying drawing figures in which.

DETAILED DESCRIPTION OF PREFERRED EMBODIMENTS

Figure 1:
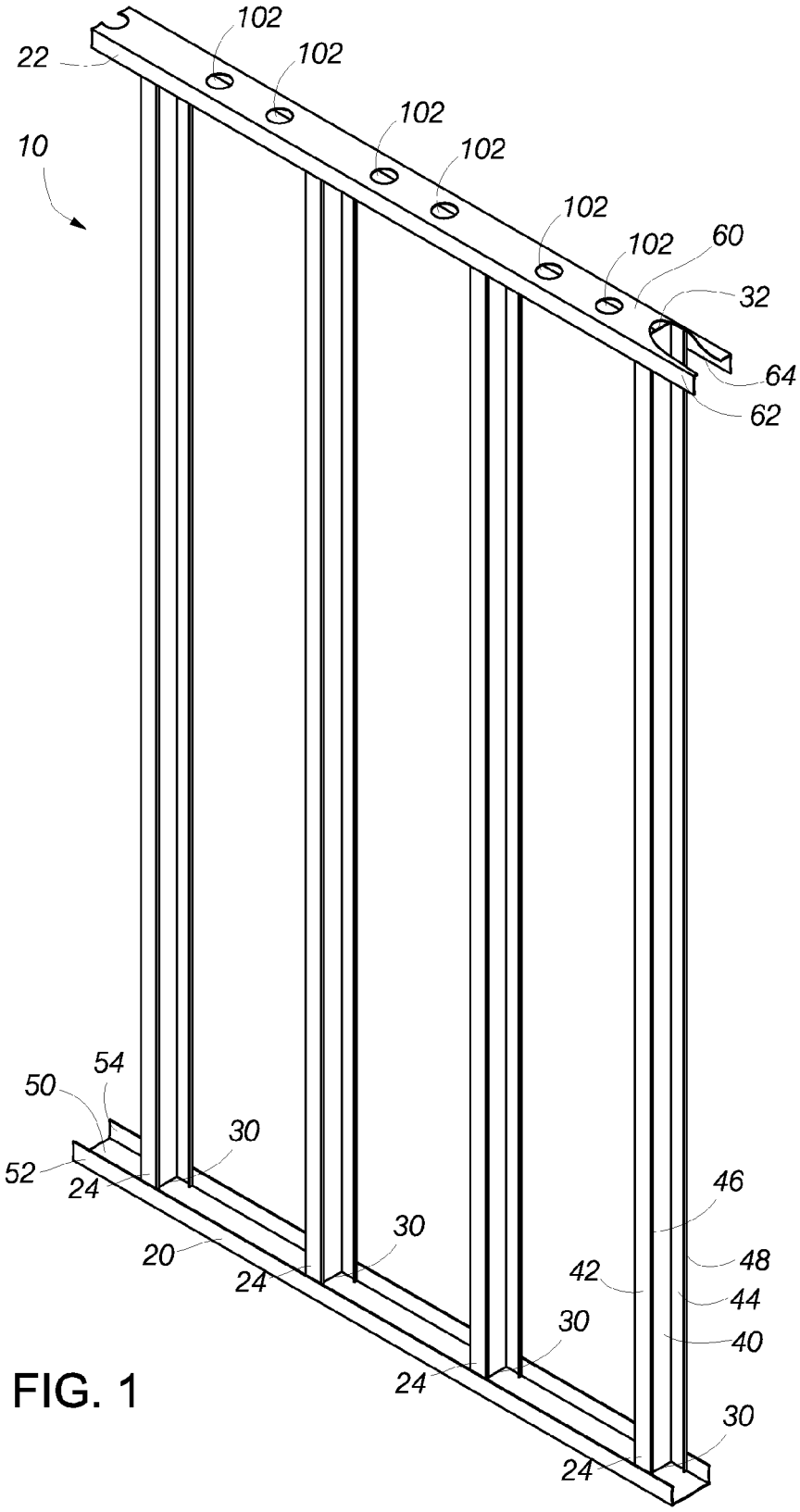
FIG. 1 is a perspective illustration of the framing of a wall section that may be used in embodiments in accordance with the disclosure herein.

FIG. 1 is a perspective illustration of a frame of a wall section 10 that may be used in embodiments in accordance with the disclosure herein. As illustrated, the wall section comprises a lower horizontal member 20. The wall section further includes an upper horizontal member 22.

The wall section further includes a plurality of vertical members 24, which may be referred to as wall studs. The vertical members have respective lower ends 30 mounted on the lower horizontal member and have respective upper ends 32 which support the upper horizontal member. The vertical members are mounted perpendicular to the horizontal member such that when the horizontal member is mounted horizontally on a foundation or other supporting surface, the vertical members are perpendicular to the supporting surface.

The lower horizontal member 20, the upper horizontal member 22 and the vertical members 24 may comprise a variety of construction materials, such as, for example, wood or metal. In the embodiments illustrated herein, the lower and upper horizontal members are metal (e.g., steel) channel sections, and the vertical members comprise metal (e.g., steel) C-sections or channel sections, which provide a combination of high strength, light weight, consistent dimensions, and fast construction. In particular, the horizontal members and the vertical members may be manufactured in a factory or at a remote location and shipped to a construction site for rapid assembly. Alternatively, entire wall sections may be prefabricated and shipped to the construction site, where the sections are interconnected before performing the steps described below.

The vertical members 24 have cross-sectional dimensions chosen in accordance with a selected wall thickness. For example, in the illustrated embodiment, the C-shaped cross section has a web 40, a first flange 42 and a second flange 44. The first and second flanges are perpendicular to the web. The two flanges have respective perpendicular lips 46 and 48, which are parallel to the web. The two flanges define a minor width of 1.5 inches, and the web defines a single major width of 3.5 inches. Thus, the dimensions of the illustrated vertical members generally correspond to the cross-sectional dimensions of a "two-by-four" construction stud. If a greater wall thickness is desired, the major width of the web may be selected to be 5.5 inches to correspond to the major width of a "two-by-six" construction stud. The minor width of the flanges may also be increased for additional strength.

In the illustrated embodiment, the lower horizontal member 20 is a lower framing track that has a structure similar to the structure of the vertical members 24. In particular, the lower horizontal member has a central web 50 and a first perpendicular flange 52 and a second perpendicular flange 54. Unlike the flanges of the vertical members 24, the flanges of the lower horizontal member do not have lips. The web of the lower horizontal member is slightly larger than the overall major width of the vertical members so that the lower ends 30 of the vertical members fit between the flanges 52 and 54. The vertical members are secured to the horizontal member by conventional interconnection devices (e.g., using screws, rivets, or other suitable fasteners (not shown)).

In the illustrated embodiment, the upper horizontal member 22 is similar to the lower horizontal member 20 and has a horizontal web 60, a first perpendicular web 62 and a second perpendicular web 64. The upper horizontal member is positioned over the upper ends 32 of the vertical members 24 between the first and second flanges and with the web resting on the upper ends. The upper horizontal member is secured to the vertical members by conventional interconnection devices (not shown).

In preferred embodiments, the vertical members 24 are spaced apart by selected distances in accordance with conventional construction techniques. For example, in the illustrated embodiment, the vertical members have a center-to-center spacing of 16 inches. In other embodiments, the vertical members have a center-to-center spacing of 24 inches.

The lengths of the vertical members 24 are selected in accordance with a desired height of the wall section. For example, when the desired height of a wall section is eight feet, the lengths of the vertical members may be slightly less than eight feet so that the combined length of a vertical member and the thicknesses of the web of lower horizontal member 20 and the web of the upper horizontal member 22 are approximately eight feet.

Figure 2:
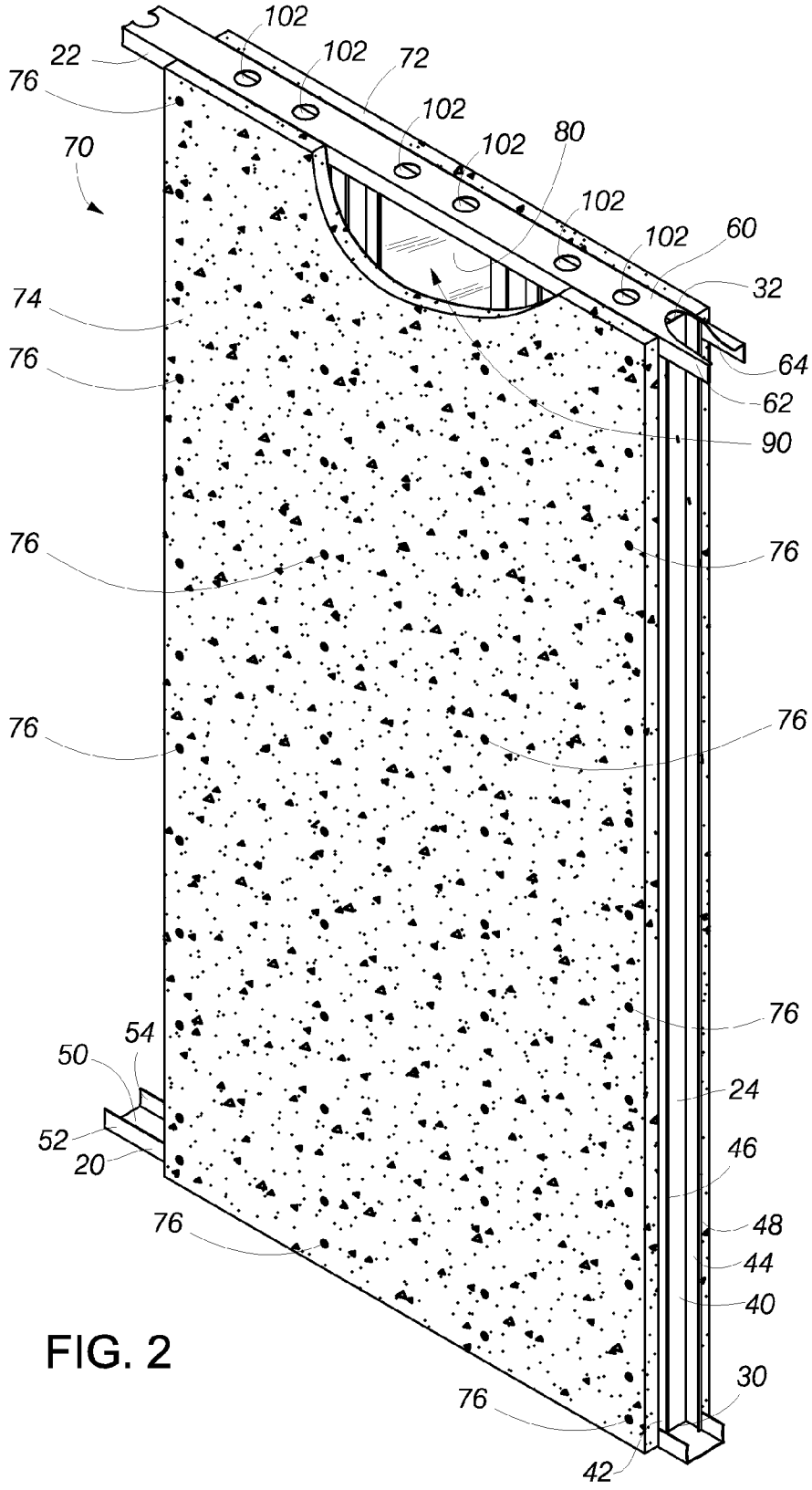
FIG. 2 is a perspective illustration of an assembled wall section in accordance with an embodiment disclosed herein, showing an outer wall panel and an inner wall panel with a portion of the inner wall panel illustrated in partial broken section to show the cavity formed between the inner wall panel and the outer wall panel.

As illustrated by an assembled wall structure 70 in FIG. 2, four adjacent vertical support members 24 of the skeletal framing structure 10 have an overall width between the centerlines of the outermost support members of 48 inches in order to support a first 4-foot by 8-foot outer wall panel 72 mounted to the flanges on one side of the vertical members and to support a second 4-foot by 8-foot inner wall panel 74 mounted to the flanges on the opposite side of the vertical members. For example, the panels are advantageously mounted to the vertical members by a plurality of suitable fasteners 76, such as, for example, self-tapping screws or nails. The panels are also mounted to the flanges of the lower horizontal member 20 and the upper horizontal member 22 in a similar manner.

Figure 3:
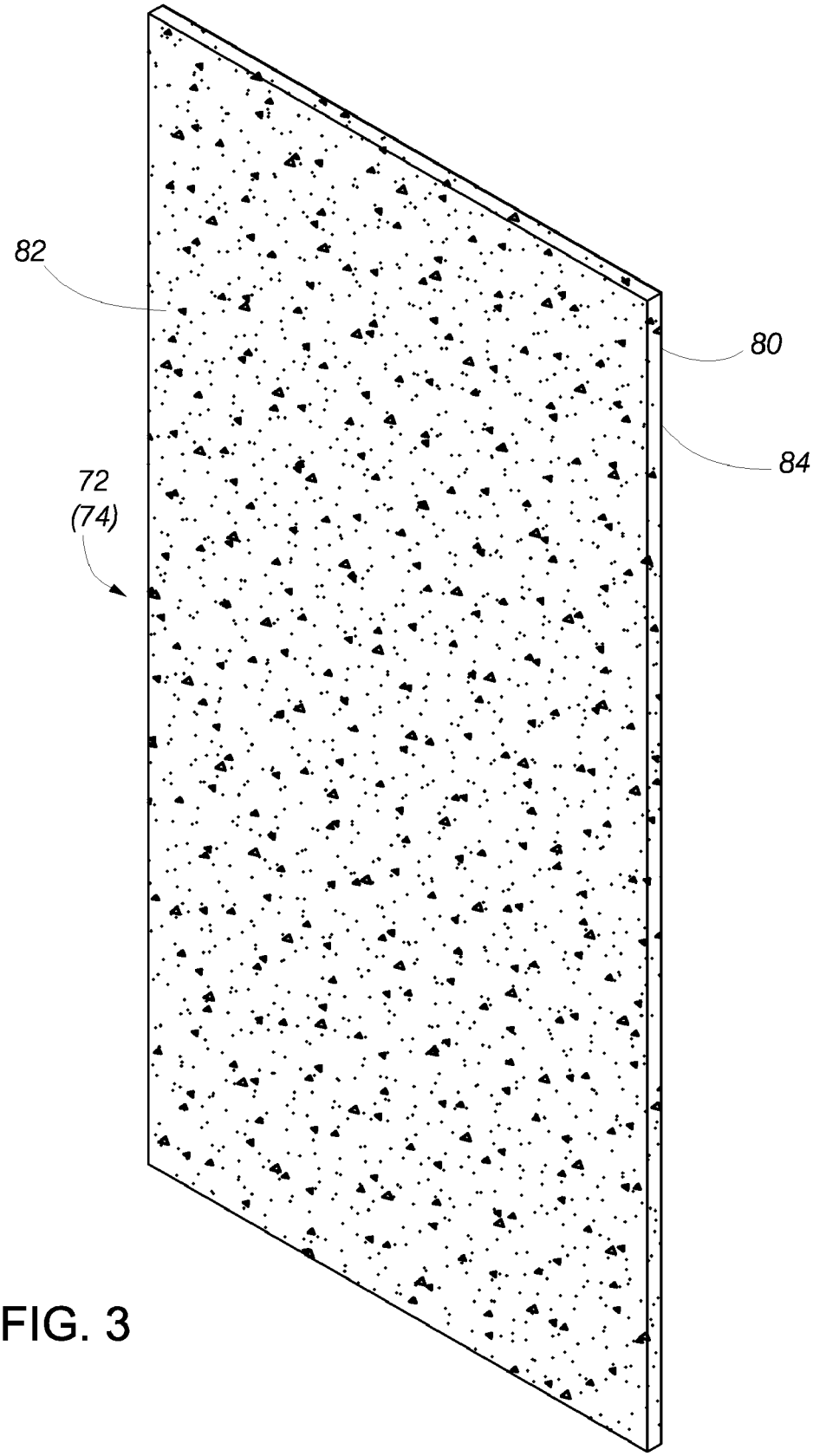
FIG. 3 is a perspective view of a shear panel used in certain embodiments of the assembled wall section of FIG. 2.
Figure 4:
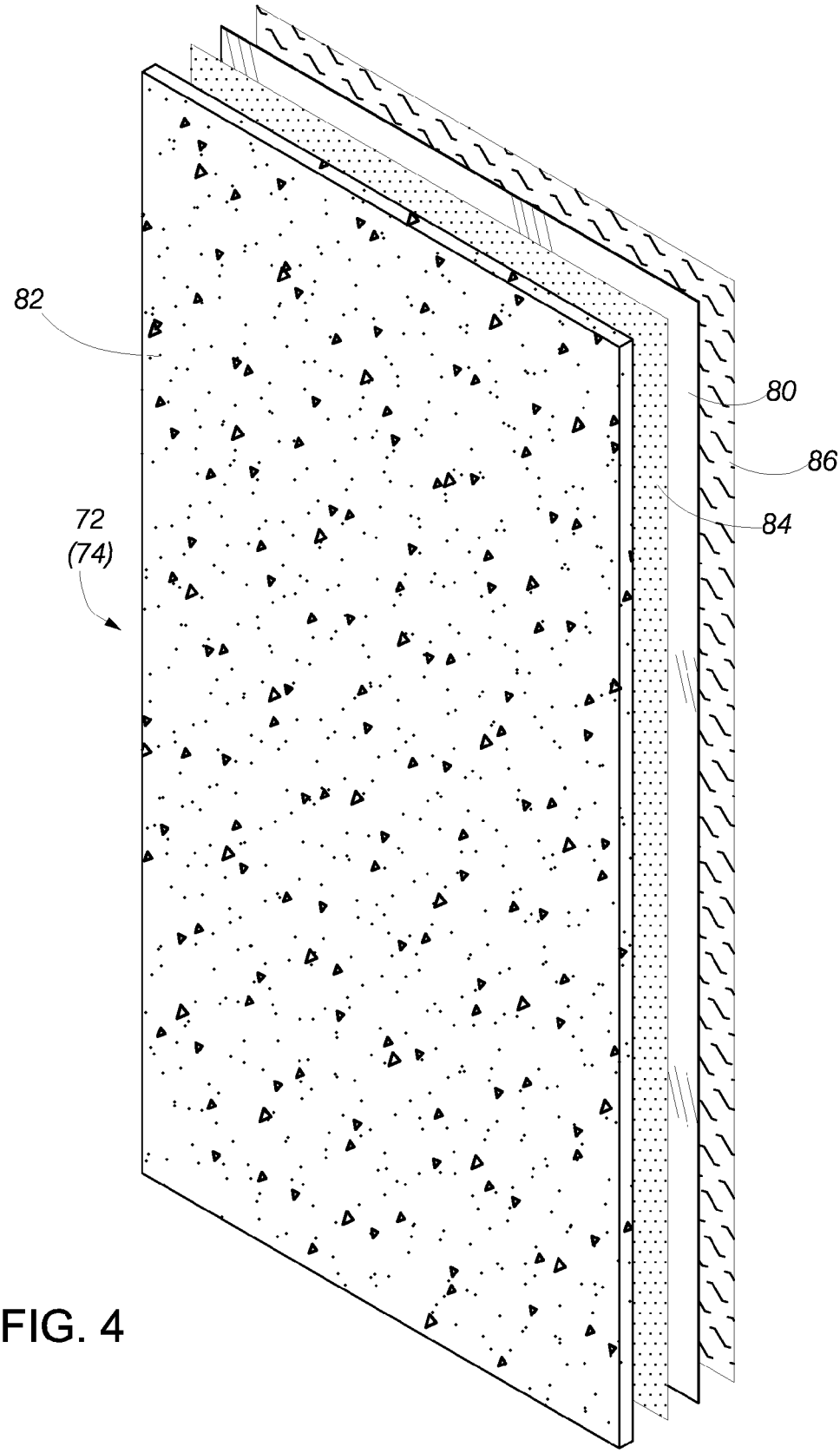
FIG. 4 is an exploded perspective view of the shear panel of FIG. 3.

In the illustrated embodiment, the outer wall panel 72 and the inner wall panel 74 are composite structures, which are illustrated in FIGS. 3 and 4. The assembled composite wall panel 72 or 74 is illustrated in FIG. 3. An exploded view of the wall panel is illustrated in FIG. 4. The structures of the outer wall panel and the inner wall panel are similar, so a single set of illustrations illustrates both types of panels.

Each of the two panels 72 and 74 comprises a wallboard structure, such as, for example, the composite wallboard structure disclosed in U.S. Pat. No. 5,768,841 to Swartz et al., which is incorporated herein by reference. As shown in the exploded view in FIG. 4, each of the outer wall panel and the inner wall panel comprises a thin metal sheet 80 attached to a wallboard panel 82. For example, in one advantageous embodiment, the metal sheet comprises steel having a thickness in a range of 0.015 inch to 0.060 inch, and the wallboard panel has a thickness in a range of 0.5 inch to 0.75 inch. It should be understood that the thickness of the metal sheet can be greater or less than the foregoing range. Similarly, the thickness of the wallboard panel can also be outside the foregoing range.

In certain embodiments, the wallboard panel 82 of the inner wall panel 74 comprises gypsum board. In certain embodiments, the wallboard panel 82 of the outer wall panel 72 may also be a gypsum board. In alternative embodiments, the wallboard panel of the outer wall panel comprises a non-combustible material such as Durock® brand underlayment available from USG Corporation headquartered in Chicago, Ill.; PermaBase® brand cement board available from National Gypsum Company headquartered in Charlotte, N.C.; and Hardiebacker 500® brand cement backerboard available from James Hardie Building Products in Mission Viejo, Calif. Other cement boards and boards comprising other non-combustible materials may also be used.

As illustrated in FIG. 4, the metal sheet 80 is secured to the wallboard panel 82 by a suitable adhesive 84 (for example, glue or epoxy) as described in U.S. Pat. No. 5,768,841 to form a composite structure. The adhesive is applied to the mating face of the metal sheet or the mating face of the wallboard panel or to the mating faces of both. The metal sheet and the wallboard panel are held together by suitable pressure until the adhesive sets.

As further illustrated in the exploded view of FIG. 4, in particularly preferred embodiments, a flexible sheet 86 of self-sealing material is attached to a surface of the metal sheets 80 (e.g., the exposed surface opposite the surface secured to the wallboard panel 82) of the two wall panels 72, 74. In particular embodiments, the sheet of self-sealing material advantageously comprises a butyl rubber material such as, for example, the material used in self-sealing vehicle tires. The sheet of self-sealing material is attached to the metal sheet by a suitable adhesive or other suitable attachment material. When the two wall panels 72, 74 are placed on the wall framing to form the assembled wall structure 70, the sheets of self-sealing material are positioned against the vertical members 24, the lower horizontal member 20 and the upper horizontal member 22.

When fastened to the framing structure 10, the outer wall panel 72 and the inner wall panel 74 assist the assembled wall structure 70 in resisting in-plane and shear loading stresses. In addition, the two panels provide the advantages described below in protecting building occupants from bullets and other ballistic projectiles.

As shown in FIG. 2, the outer wall panel 72 and the inner wall panel 74 and each adjacent pair of vertical support members 24 define a cavity 90 between the lower horizontal member 20 and the upper horizontal member 22. In conventional construction, such a cavity might be filed with fiberglass or other insulation to reduce the transfer of thermal energy into and out of the structure formed by a plurality of similar wall sections.

Figure 5:
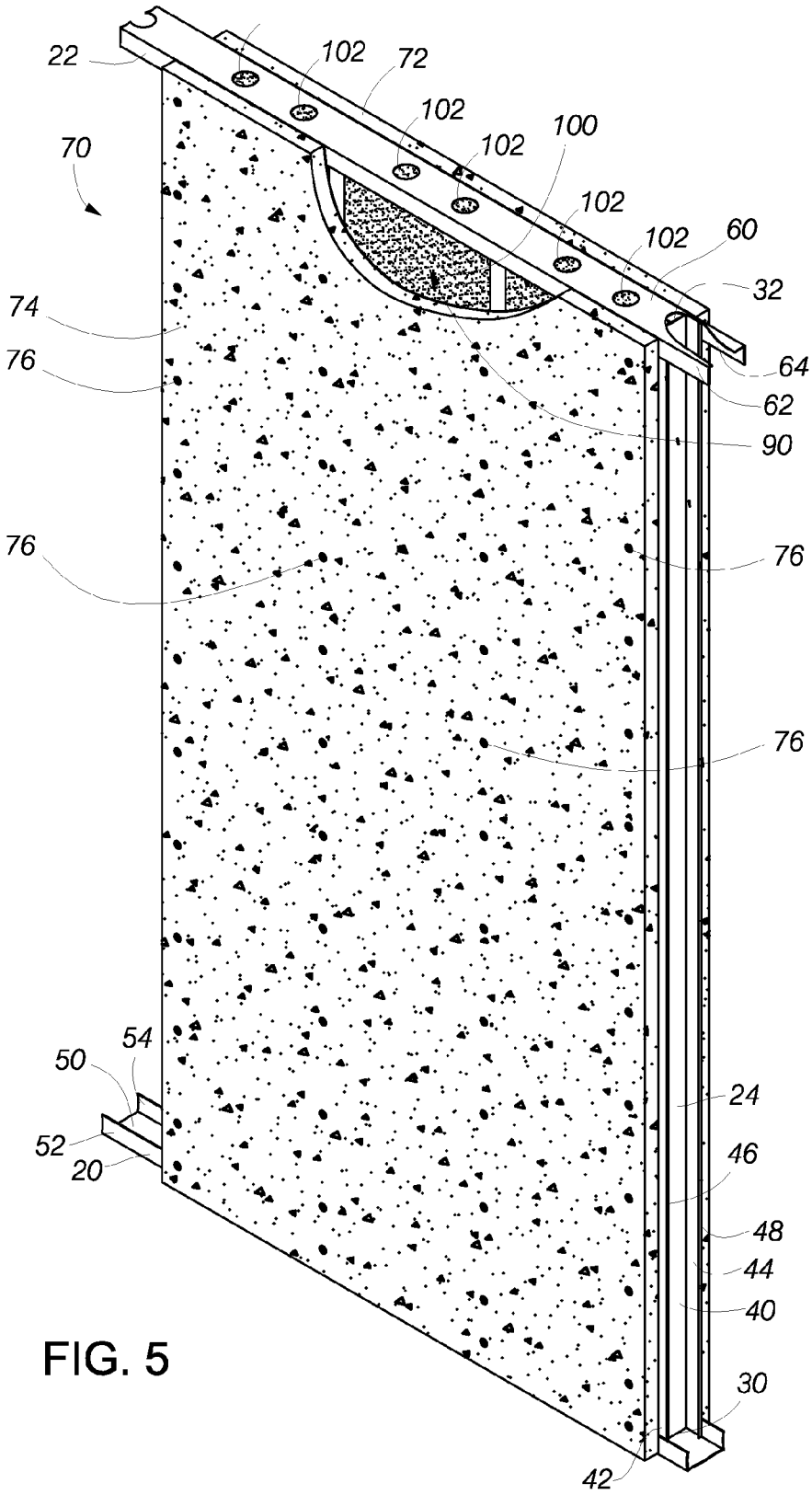
FIG. 5 is a perspective illustration of the assembled wall section of FIG. 2, with a portion of the wall section illustrated in partial broken section to show a granular material filling the cavity between the inner wall panel and the outer wall panel.

As illustrated in FIG. 5, after the wall section 70 is erected and the outer wall panel 72 and the inner wall panel 74 are securely attached, the cavity 90 thus formed between each pair of adjacent vertical support members 24 is filled with a granular material 100. In preferred embodiments, the granular material is a stony material. In particularly preferred embodiments, the granular material is sand, which is readily available throughout the world and is quite plentiful in the Middle Eastern countries. Furthermore, sand is easy to manipulate so that it can be added to the cavity through a plurality of holes 102 formed in the upper horizontal member 22. The grains of sand tend to evenly fill the cavity and to pack into a dense mass. Any incomplete filling of the cavity proximate to the upper horizontal support member is acceptable since the occupants of a structure incorporating the wall section are not likely to be at the level of the top of the wall section.

The embodiment of FIG. 5 provides a first level of protection from ballistic projectiles in comparison to conventional construction. In particular, the densely packed sand 100 (or other granular filler material) between the outer wall panel 72 and the inner wall panel 74 causes a significant reduction in the velocity of a ballistic projectile that penetrates the outer wall panel. For some projectiles, the residual velocity of the projectile after passing through the sand may be insufficient to penetrate the metal sheet 80 of the inner wall panel. Even if the projectile penetrates the metal sheet, the combined slowing effect of the sand and the metal sheet may be sufficient to reduce the extent of injury upon a person hit by the projectile. As discussed above, in preferred embodiments, the sheet 86 of self-healing material is positioned on the metal sheets of the two wall panels as shown in FIG. 4. Thus, an opening caused during the passage of a projectile penetrating the outer wall panel will be substantially closed after the passage of the projectile to prevent or reduce the leakage of the sand from the cavity 90. Similarly, the sheet of self-healing material on the inner wall panel will prevent or reduce the leakage of sand through an opening formed by the passage of a projectile through the inner wall panel.

Figure 6:
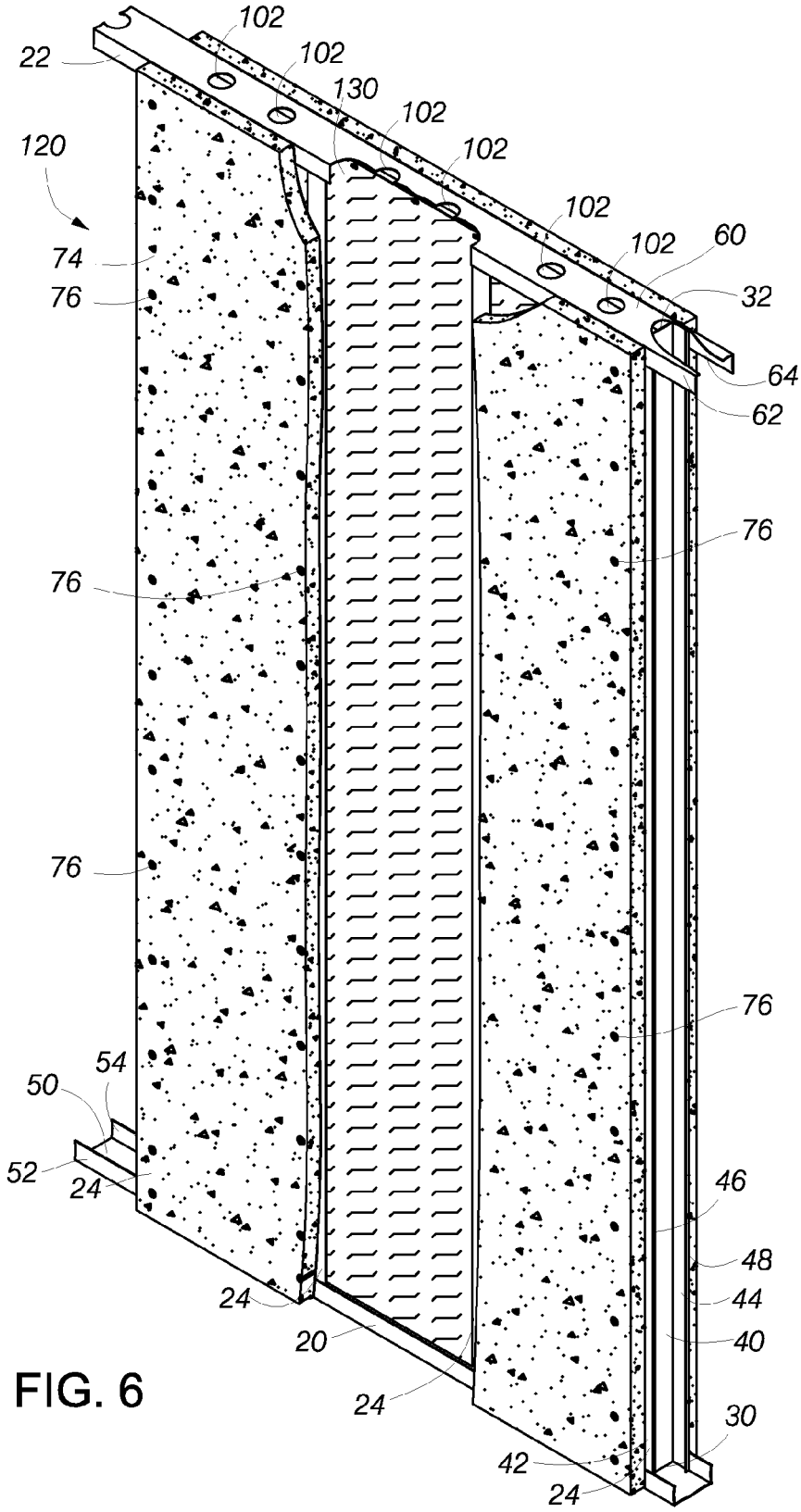
FIG. 6 is a perspective illustration of an assembled wall section in accordance with a further embodiment disclosed herein, showing an outer wall panel and an inner wall panel with a portion of the inner wall panel illustrated in partial broken section to show a flexible sheet suspended in the cavity between the inner wall panel and the outer wall panel prior to adding the granular filling material.
Figure 7:
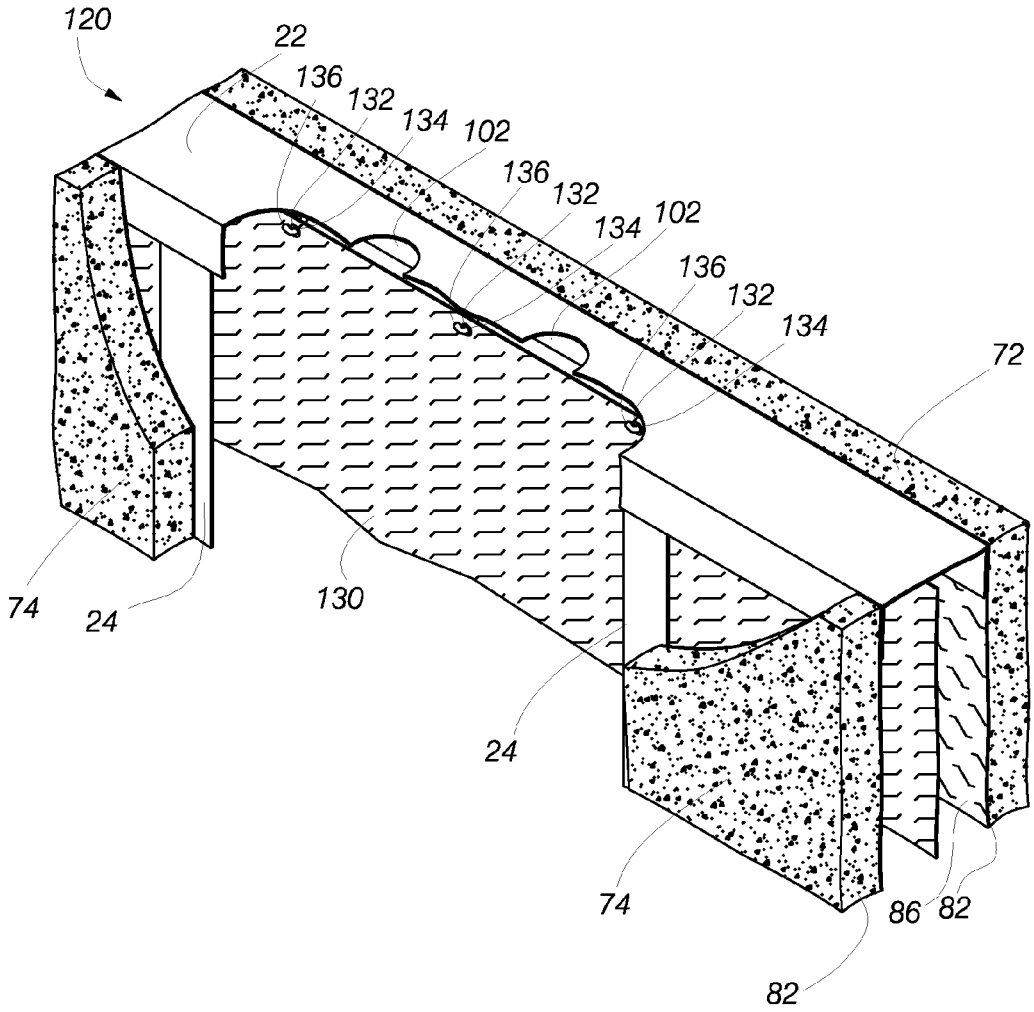
FIG. 7 is an enlarged perspective view of the top portion of the wall section of FIG. 6 to show the suspended flexible sheet in more detail.
Figure 8:
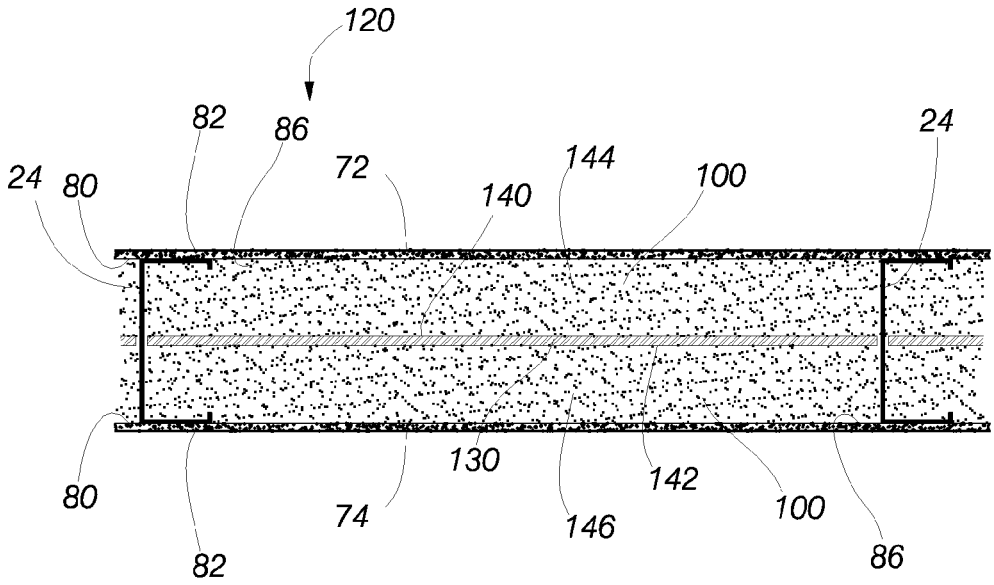
FIG. 8 is a cross-sectional illustration of a wall section in accordance with the embodiment of FIGS. 6 and 7, further showing the granular filling material in the first and second volumes of the cavity formed between the flexible sheet and the inner and outer wall panels.

FIGS. 6, 7 and 8 illustrate an embodiment of an assembled wall section 120 that provides an additional level of ballistic protection. FIGS. 6 and 7 illustrate the wall section prior to adding the granular filling material (e.g., sand) 100. FIG. 8 illustrates the wall section after adding the granular filing material. In FIG. 6, a portion of the inner wall is broken away to show a flexible sheet 130. The flexible sheet advantageously comprises a suitable thickness of rubber, such as, for example, rubber manufactured from recycled tires. As shown in FIG. 7, the flexible sheet has a plurality of holes 132 formed proximate to an upper end. Preferably, each of the holes is reinforced with a respective grommet 134.

As illustrated in the enlarged perspective view in FIG. 7, the flexible sheet 130 is suspended from the upper horizontal member 22 via a plurality of hooks 136, which pass through the grommets 134. Preferably, the hooks are positioned approximately at the center of the web 60 of upper horizontal member so that the flexible sheet is suspended in the cavity 90 between the outer wall panel 72 and the inner wall panel 74. For example, in the embodiment illustrated in FIG. 7, the flexible sheet is positioned approximately in the middle of the cavity.

The flexible sheet 130 has a length that is selected to so that the flexible sheet spans substantially the entire distance from the upper horizontal member 22 to the lower horizontal member 20. The flexible sheet has a width selected to span the distance between adjacent vertical members 24. For example, in a wall section using metal studs having a center-to-center spacing of 16 inches, the flexible sheet has a width of slightly less than 16 inches. If wooden 2 by 4 studs are used, the flexible sheet has a width of approximate 14.5 inches to accommodate the thickness of the studs. In a wall section using metal studs having a center-to-center spacing of 24 inches, the flexible sheet has a width of slightly less than 24 inches.

Preferably, the flexible sheet 130 is suspended in the cavity 90 before adding the outer wall panel 72, the inner wall panel 74 and the sand (or other granular filler material) 100. As illustrated in the enlarged cross-sectional view in FIG. 8, the flexible sheet has a first face 140 and a second face 142. The first face is closer to the outer wall panel, and the second face is closer to the inner wall panel. The flexible sheet divides the cavity into a first volume 144 and a second volume 146. The first volume is formed between the first face of the flexible sheet and the outer wall panel. The second volume is formed between the second face of the flexible sheet and the inner wall panel. The first volume and the second volume are filled with the sand so that a first portion of the sand is between the flexible sheet and the outer wall panel and a second portion of the sand is between the flexible sheet and the inner wall. In the illustrated embodiment, the two volumes of sand are approximately the same; however, in other embodiments, one volume may be greater than the other volume in accordance with the placement of the flexible sheet in the cavity.

In the embodiment of FIGS. 6, 7 and 8, the sand (or other granular filler material) 100 is added in a controlled manner so that the levels of the sand in the two volumes 144 and 146 increase at substantially the same rate so that the flexible sheet 130 is not significantly displaced from an initial vertical orientation beneath the upper horizontal member.

The embodiment of FIGS. 6, 7 and 8 provides a second level of protection from ballistic projectiles. In particular, in addition to the velocity retarding effect provided by the densely packed sand (or other granular filler material) 100, the flexible sheet 130 causes a further reduction in the velocity of a ballistic projectile. Although the flexible sheet has sand on both sides, the flexible sheet has a tendency to yield to the force of an impinging projectile. The yielding effect of the flexible sheet will further reduce the velocity of the projectile. Furthermore, the yielding movement of the flexible sheet may deflect the projectile such that the projectile passes through the flexible sheet and the sand at an angle that differs from the incident angle. Hence, the deflection may increase the length of the path of the projectile through the sand, thus providing an additional slowing effect. The combination of the metal sheets 80 of the two wall panels 72 and 74, the sand in the first volume 144, the flexible sheet, and the sand in the second volume 146 increases the probability that a ballistic projectile will be slowed sufficiently to reduce the extent of injury upon a person hit by the projectile. As discussed above, in preferred embodiments, the sheets 86 of self-healing material on the two wall panels assist in reducing or eliminating leakage through openings caused by passages of projectiles through the wall panels.

Figure 9:
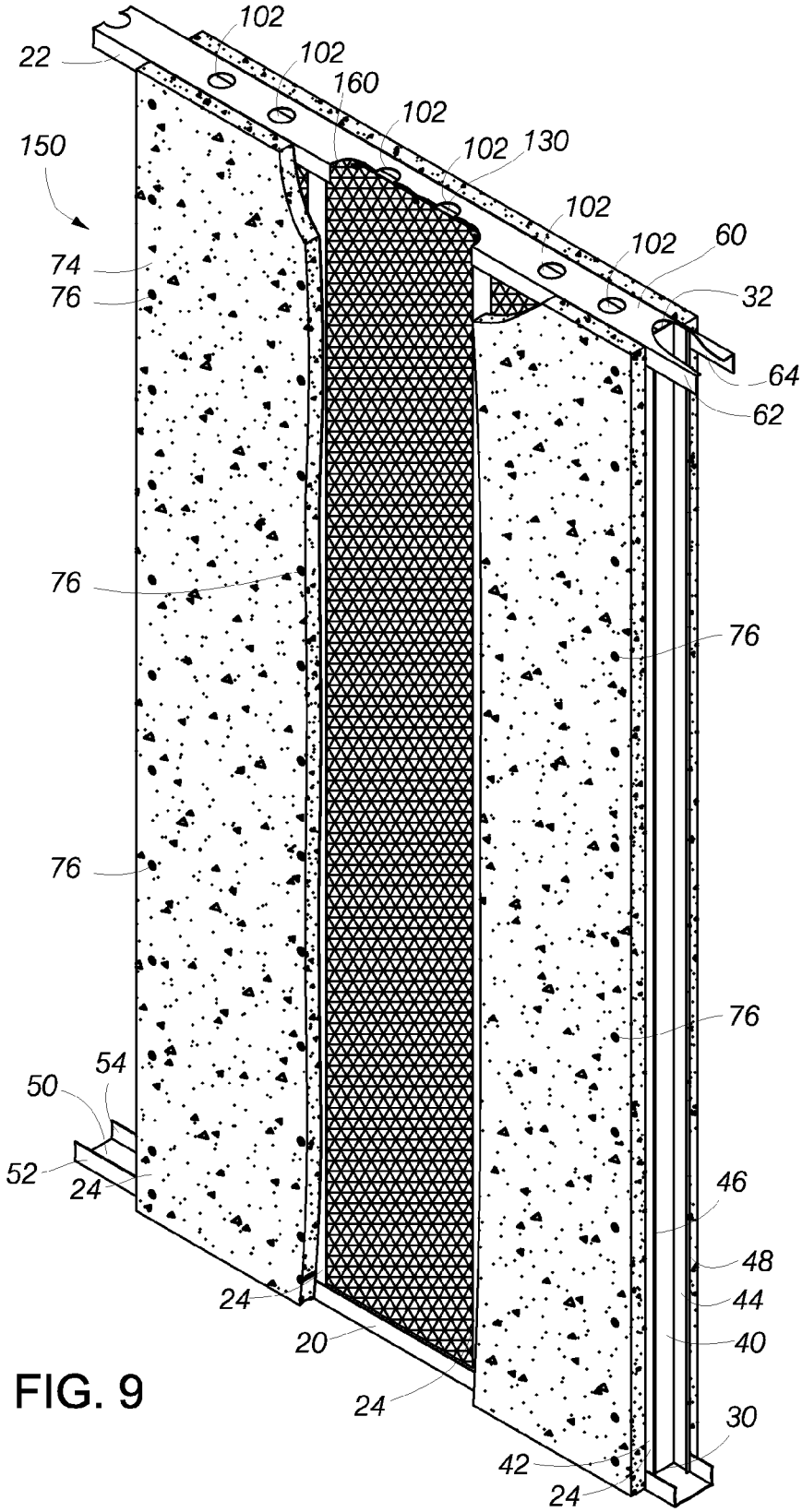
FIG. 9 is a perspective illustration of an assembled wall section in accordance with a further embodiment disclosed herein, showing a sheet of woven, high-tensile strength fiber loosely attached to the flexible sheet of FIGS. 6-8, prior to adding the granular filling material.
Figure 10:
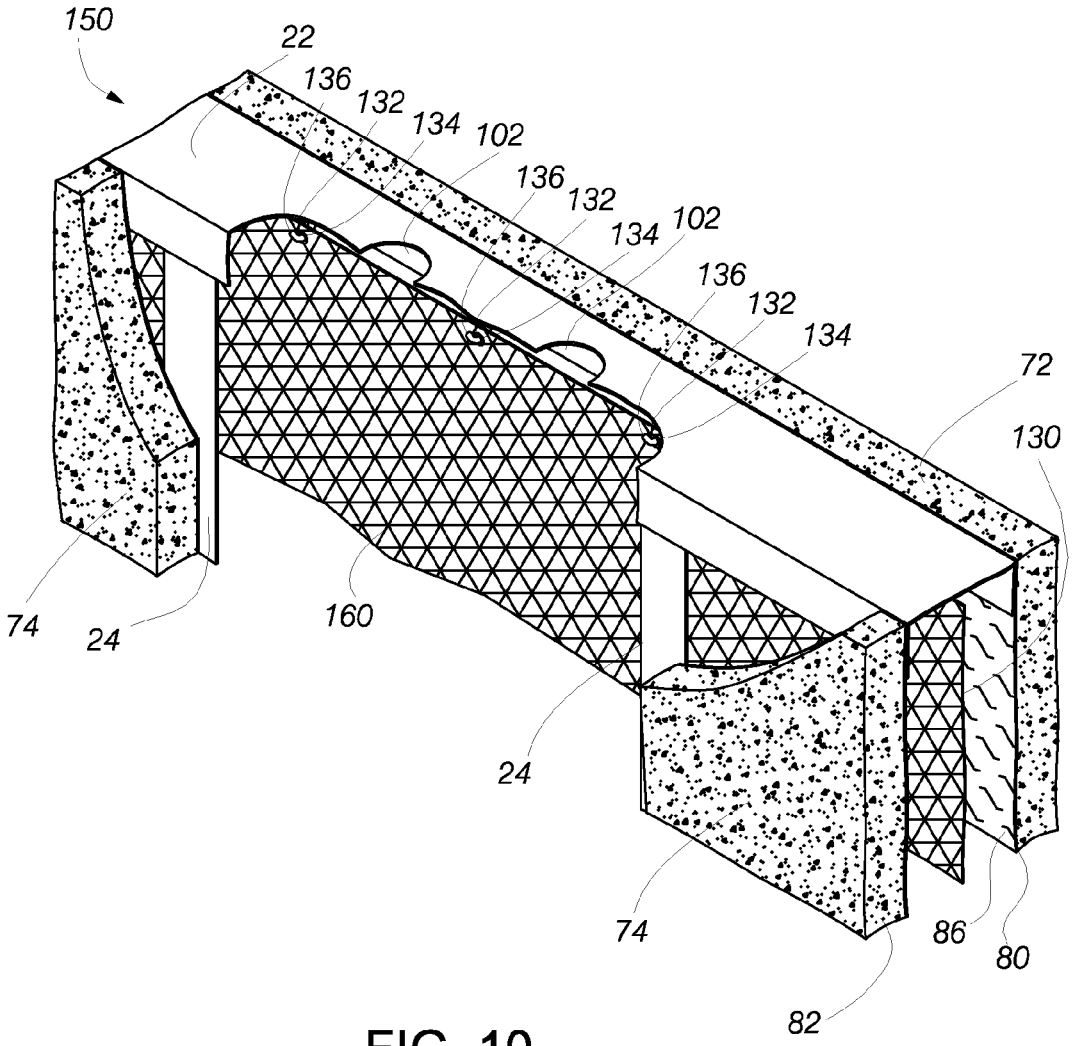
FIG. 10 is an enlarged perspective view of the top portion of the wall section of FIG. 9 to show the sheet of woven fiber in more detail.
Figure 11:
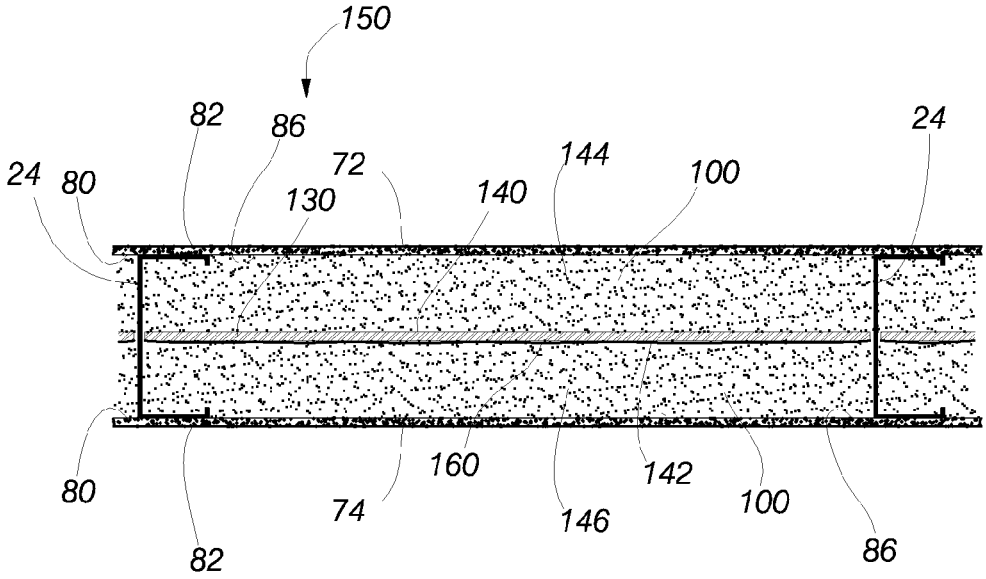
FIG. 11 is a cross-sectional illustration of a wall section in accordance with the embodiment of FIGS. 9 and 10, further showing the granular filling material in the first volume of the cavity formed between the flexible sheet and the outer wall panel and the second volume of the cavity formed between the sheet of woven fiber and the inner wall panel.

FIGS. 9, 10 and 11 illustrate a further improvement in an assembled wall section 150 that provides an additional level of protection. The assembled wall section in FIGS. 9-11 is similar to the embodiment of FIGS. 6 and 7 with the addition of a sheet 160 of woven, high tensile strength fiber loosely coupled to the second face 142 of the flexible sheet 130. The woven sheet is shown in the perspective view of FIG. 9 and in the enlarged cross-sectional view of FIG. 10. In a preferred embodiment, the woven fiber sheet comprises a para-aramid fiber such as KEVLAR® fiber manufactured by E.I. du Pont de Nemours and Company or a similar material.

The woven fiber sheet 160 is attached to the second face 142 of the flexible sheet 130 at a plurality of widely spaced spots using a suitable adhesive. Thus, the woven fiber sheet hangs parallel to the flexible sheet. In the illustrated embodiment, the woven fiber sheet is mounted to the second face 142 of the flexible sheet so that a ballistic projectile passes through the flexible sheet before encountering the woven fiber sheet. Since the woven fiber sheet is loosely coupled to the flexible sheet, the fibers of the woven fiber sheet are able to move freely when impacted by the ballistic projectile, thus increasing the likelihood that the woven fiber sheet will capture the projectile rather than allowing the projectile to pass through the woven fiber sheet. Even if the projectile does pass through the woven fiber sheet, the velocity of the projectile will be further reduced, thus increasing the probability that the projectile will be stopped or sufficiently slowed by the combination of the sand in the second volume 146 and the metal sheet 80 of the inner wall panel 74 so that the projectile will not harm a person protected by the wall section 150. As discussed above, in preferred embodiments, the sheets 86 of self-healing material on the two wall panels assist in reducing or eliminating leakage through openings caused by passages of projectiles through the wall panels.

As illustrated in the foregoing embodiments, the walls of a structure can be erected easily and quickly at a construction site. The metal construction materials, the panels and the flexible sheet can be easily transported to a construction site and installed as described above. Alternatively, the wall sections, including the flexible sheet if desired, can be prefabricated and delivered to a construction site ready to be interconnected. After the walls are erected in either manner, the sand is added to the cavities of the wall sections. The sand to fill the cavities can be found at many construction sites or can be readily hauled to a construction site.

Figure 12:
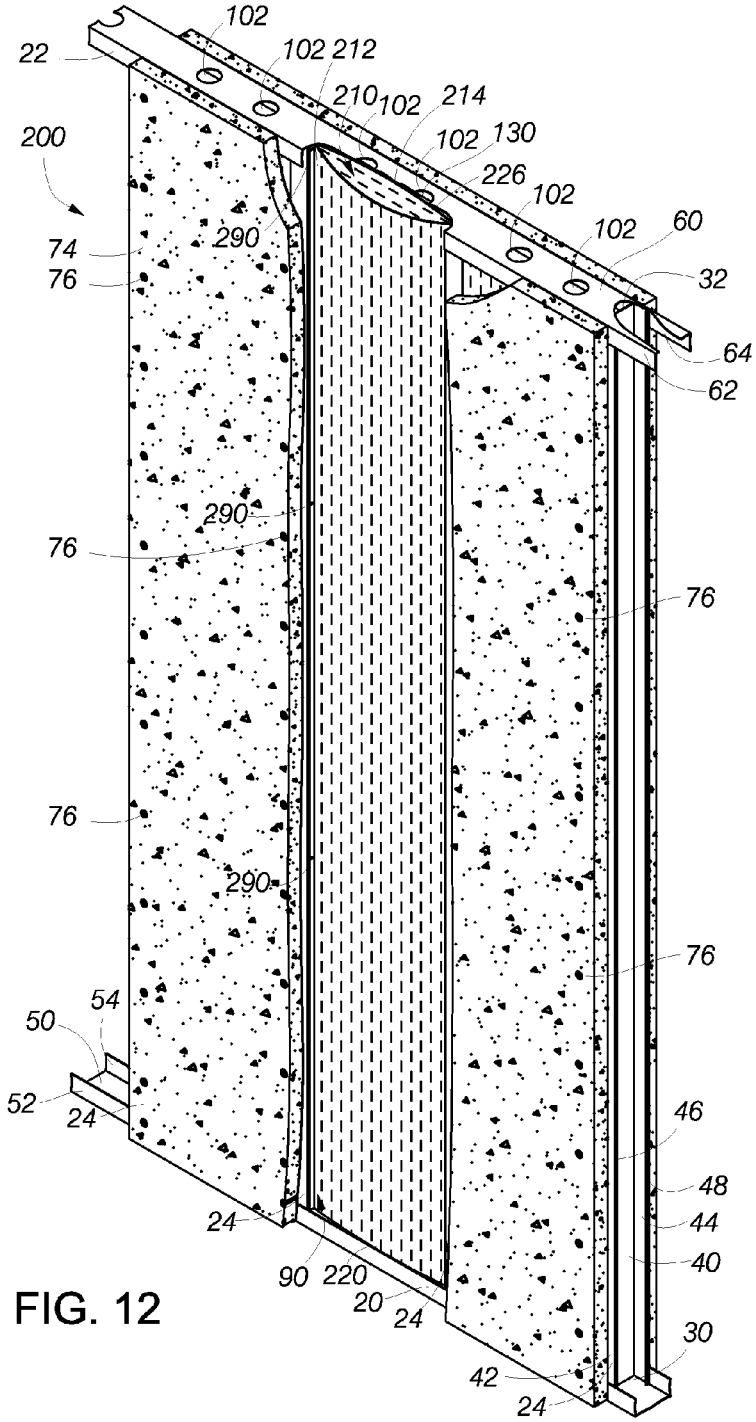
FIG. 12 is a perspective illustration of an assembled wall section in accordance with a further embodiment disclosed herein, showing two sides of woven high-tensile strength fiber interconnected along at least portions of three edges to form a bag-like structure, the bag-like structure supported within the wall section between adjacent studs.

FIG. 12 illustrates a further embodiment of an assembled wall section 200 in which the flexible sheet is embodied as a bag-like structure 210. The upper portion of the wall section and the bag-like structure 210 are shown in more detail in the enlarged view in FIG. 13. The outer portions of the wall structure of FIGS. 12 and 13 correspond to the portions of the wall structure 150 in the other figures and are numbered as before.

FIGS. 14-19 illustrate an exemplary method for constructing the bag-like structure 210. In FIGS. 14-19, the length of the bag-like structure is reduced for illustrative purposes only. It is understood that the overall length of the bag-like structure is selected in accordance with the height of the cavity As shown in more detail in FIG. 16, the bag-like structure 210 comprises a first side 212 of woven, high tensile strength fiber and a second side 214 of woven, high tensile strength fiber. For example, the sheet may comprise Kevlar® sheet material in certain embodiments. The two sides are interconnected along at least portions of three edges of the two sides to form an enclosure having a closed bottom 220, a first closed vertical side 222, a second closed vertical side 224 and an open top 226.

In the illustrated embodiment, the first side 212 and the second side 214 of the bag-like structure 210 are formed from a single, generally rectangular sheet 230 of the woven, high tensile strength fiber having a first end 232, a second end 234, a first edge 236 and a second edge 238. The length and width of the single sheet are selected to conform to the height, width and thickness of the wall structure 200, as discussed below. Preferably, the two edges and the two ends of the sheet are finished (e.g., serged, hemmed, overlocked, or the like) in a suitable manner to prevent fraying of the fibers exposed at the edges and the ends.

Figure 14:
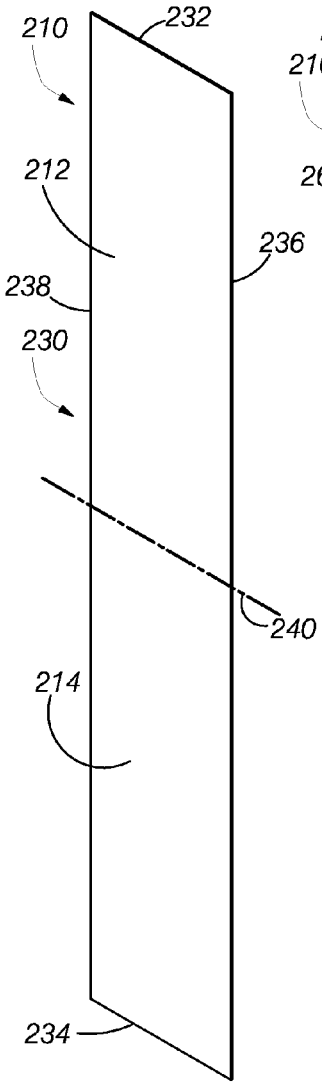
FIG. 14 is a perspective illustration of a single sheet of woven prior to folding and interconnecting two portions to form the bag-like structure of FIG. 12.
Figure 15:
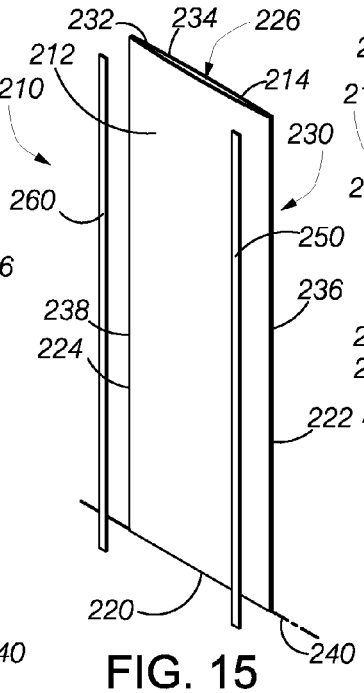
FIG. 15 is a perspective illustration of the single sheet of woven material after folding and prior to interconnecting the two sides and further showing the reinforcement strips prior to attachment to the woven material.
Figure 16:
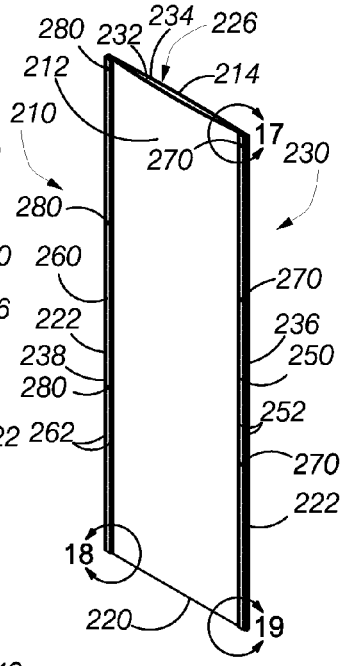
FIG. 16 illustrates the completed bag-like structure after interconnection of the two sides by sewing the reinforcement strips to the front side of the bag-like structure to close the two edges.
Figure 17:
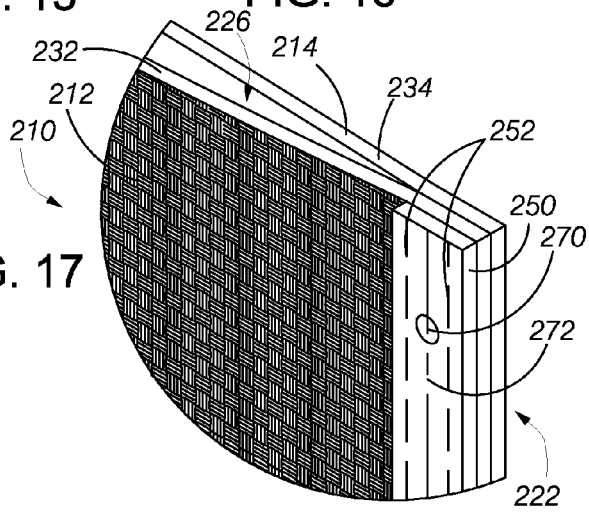
FIG. 17 is an enlarged perspective view of the bag-like structure of FIG. 16 in the area 17 of FIG. 16.
Figure 18:
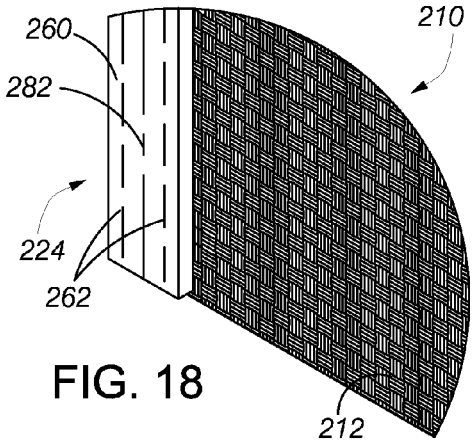
FIG. 18 is an enlarged perspective view of the bag-like structure of FIG. 16 in the area 18 of FIG. 16.
Figure 19:
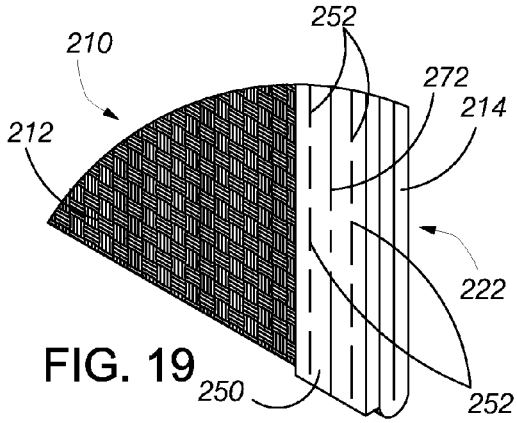
FIG. 19 is an enlarged perspective view of the bag-like structure of FIG. 16 in the area 19 of FIG. 16.

As shown in FIG. 14, the single sheet 230 is divided into two generally equal portions about a centerline 240 positioned parallel to and generally equidistant from the first end 232 and the second end 234. As shown in FIG. 15, the single sheet is folded substantially in half along the centerline so that the upper portion and the lower portion in FIG. 14 are positioned back-to-back to form the bag-like structure 210. The two portions of the first edge 236 form the first side 222. The two portions of the second edge 238 form the second side 224. The folded portion of the single sheet along the centerline forms the closed bottom 220 of the bag-like structure. Since the bag-like structure is formed from the single sheet, the closed bottom is seamless as shown in the enlarged view in FIG. 19. The first end 232 and the second end 234 of the single sheet are generally aligned to form the open top 226 of the bag-like structure. At least portions of the two aligned ends are not interconnected so that an opening is formed at the top of the bag-like structure 200 between the two ends.

The aligned first portion 236A and second portion 236B of the first edge 236 are interconnected in a suitable manner. Similarly, the aligned first portion 238A and second portion 238B of the second edge 238 are interconnected in a suitable manner.

In the illustrated embodiment, the two portions of the first edge 236 are interconnected using at least a first strip 250 of a suitable reinforcement material having a width of approximately 1 inch in the illustrated embodiment. The first strip is positioned over the first side 212 substantially from the top 226 to the bottom 220 and is aligned with the first edge so that the first strip overlaps approximately 1 inch of the first side proximate to the first edge. The first strip is secured to the underlying first side and second side 214 by two or more parallel rows of stitches 252 extending from the top to the bottom. Thus, the two portions of the first edge are interconnected to form the first closed vertical side 222, which is reinforced by the first strip. The first closed vertical side is shown in more detail in the enlarged view in FIG. 17. The relative thicknesses of the materials are not illustrated to scale.

In the illustrated embodiment, the two portions of the second edge 238 are interconnected using a second strip 260 of the reinforcement material having a similar width. The second strip is positioned over the first side 212 substantially from the top 226 to the bottom 220 and is aligned with the second edge so that the second strip overlaps approximately 1 inch of the first side proximate to the second edge. The second strip is secured to the underlying first side and second side 214 by two or more parallel rows of stitches 262 extending from the top to the bottom. Thus, the two portions of the second edge are interconnected to form the second closed vertical side 223, which is reinforced by the second strip.

Although the two reinforcement strips 250 and 260 are only shown on the two edges of the first side 212, additional reinforcement can be provided by including corresponding reinforcement strips (not shown) on the second side 214 and sewing through the respective pairs of reinforcement strips.

After securing the first reinforcement strip 250 to the first edge 236 of the first side 212 and securing the second reinforcement strip 260 to the second edge 238 of the first side, a first plurality of mounting holes 270 are formed through the first strip and the underlying layers of the sheet 230 along a first vertical centerline 272 approximately in the middle of the first strip. A second plurality of mounting holes 280 are formed through the second strip and the underlying layers of the sheet along a second vertical centerline 282. For example, in the illustrated embodiment, three holes are formed in each strip, with one hole located near the top of the respective strip, with one hole located approximately one-third of the distance from the top of the respective strip to the bottom of the strip, and with one hole located approximately two-thirds of the distance from the top of the respective strip to the bottom of the strip. The holes are advantageously formed through the reinforcement strips and the underlying layers of the sheet by a suitable procedure, such as, for example, drilling. The reinforcement strips provide a suitable base for drilling through the strips and through the two underlying layers of the sheet without significant fraying of the material in the sheet. Additional inhibition of fraying can be provided by stitching (not shown) around the positions of the holes prior to drilling or otherwise forming the holes. In addition to inhibiting fraying of the woven fibers, the reinforcement strips assist in bearing the load and spreading the load over a larger area of the sheet when the bag-like structure 210 is mounted in the wall structure 200 as shown in FIGS. 12 and 13 and is optionally filled with additional material, as described below.

In the illustrated embodiment, the strips 250, 260 of reinforcement material advantageously comprise a strong felt-like backing material, such as, for example, the material used as the backing material for the loop portion of a loop and hook interconnection combination, which is sold, for example, under the brand name VELCRO®.

Figure 13:
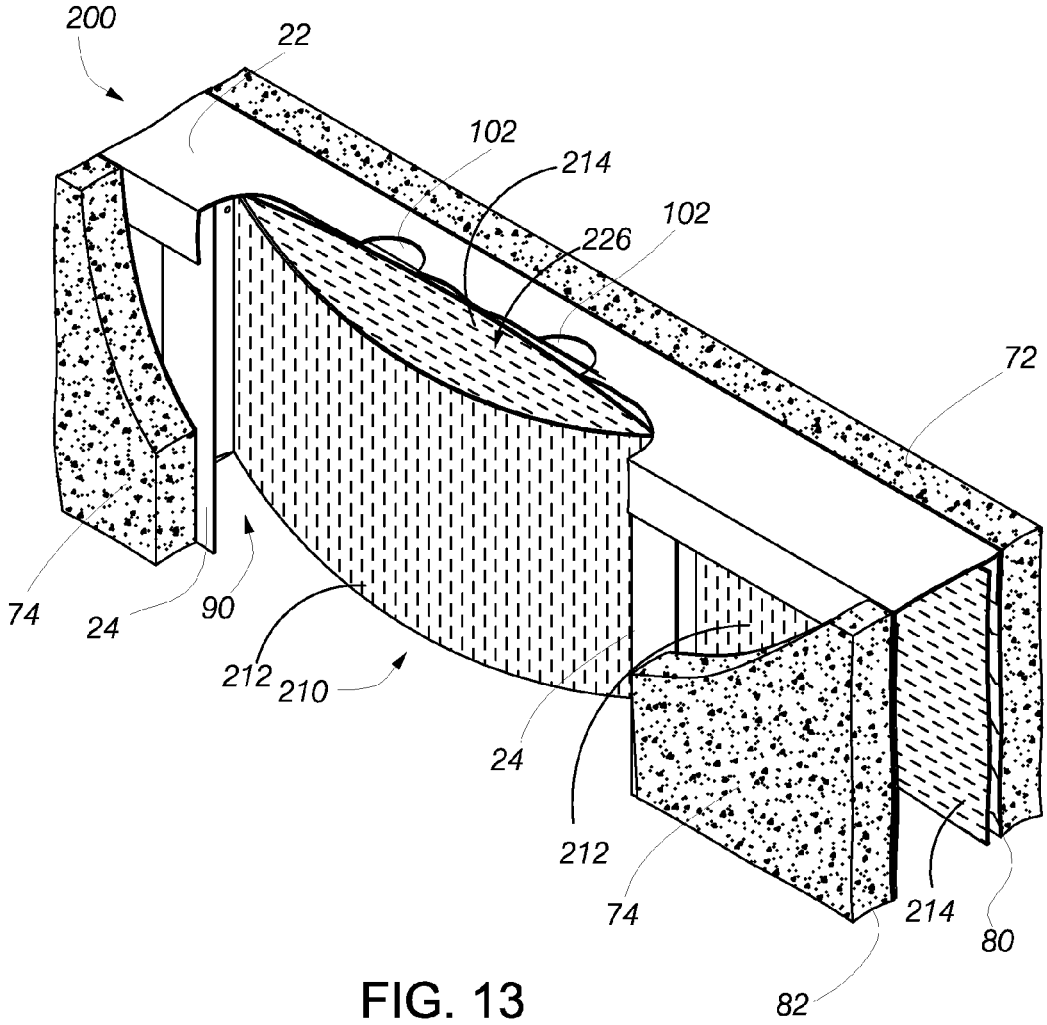
FIG. 13 is an enlarged perspective view of the top portion of the wall section of FIG. 12 to show the bag-like structure in more detail.

The bag-like structure 210 formed in the manner described above is mounted in the wall section 200, as shown in FIG. 12 and in the enlarged view in FIG. 13. In particular, the bag-like structure is positioned in the cavity 90 of the wall structure 200 and is secured to the vertical members 24 forming the vertical boundaries of the wall section by fasteners 290 (e.g., sheet metal screws) that pass through the mounting holes 270 and 280 and engage the vertical members.

After mounting the bag-like structure 210 in the cavity 90 of the wall structure 200, the bag-like structure may remain empty as shown in FIGS. 12 and 13. The woven, high tensile strength fiber that comprises the two sides 212 and 214 of the bag-like structure in combination with the previously described outer wall panel 72 and inner wall panel 74 to block the entry or to substantially reduce the velocity of projectiles directed at the wall structure. In particular, the flexible sides of the bag-like structure inhibit penetration because of the woven structure of the high tensile strength fibers and also because the yielding movements of the sides absorb and deflect much of the forward momentum of a projectile.

The bag-like structure 210 may be installed and remain empty to provide the projectile inhibition benefits of the two sides 212 and 214 of the woven, high tensile strength fiber. In alternative embodiments, the flexible cavity formed between the two sides of the bag-like structure is filled with a suitable material to provide additional safety or environmental benefits. For example, in the enlarged view of the top of the wall section 200 in FIG. 19, the bag-like structure is filled with a granulated material 300, such as, for example, sand. The first closed vertical side 222, the closed second vertical side 224 and the closed bottom 220 assure that the sand or other granulated material remain within the bag-like structure. Accordingly, any projectile penetrating the outer wall panel 72 and penetrating the second side 214 of the bag-like structure will be further slowed by the granulated material to increase the probability that the projectile will be stopped or substantially slowed by the first side 212 of the bag-like structure so that the projectile does not penetrate the inner wall panel 74. The sand or other granulated material may be added to the bag-like structure directly through the open top 226 before securing one of the outer wall panel or the inner panel to the wall structure, or the sand or other granulated material may be added by pouring the granulated material through one of the upper holes a plurality of holes 102 formed in the upper horizontal member 22.

Figure 20:
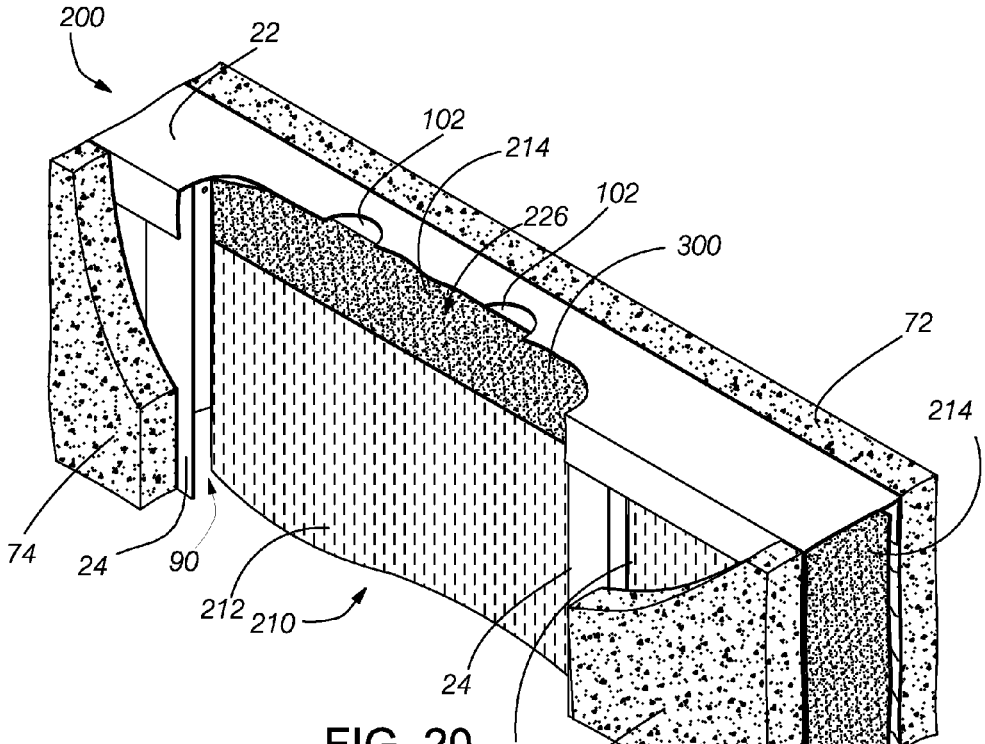
FIG. 20 illustrates a perspective view of the top portion of the wall section similar to the view in FIG. 13 but with the bag-like structure filled with a granular material such as sand.
Figure 21:
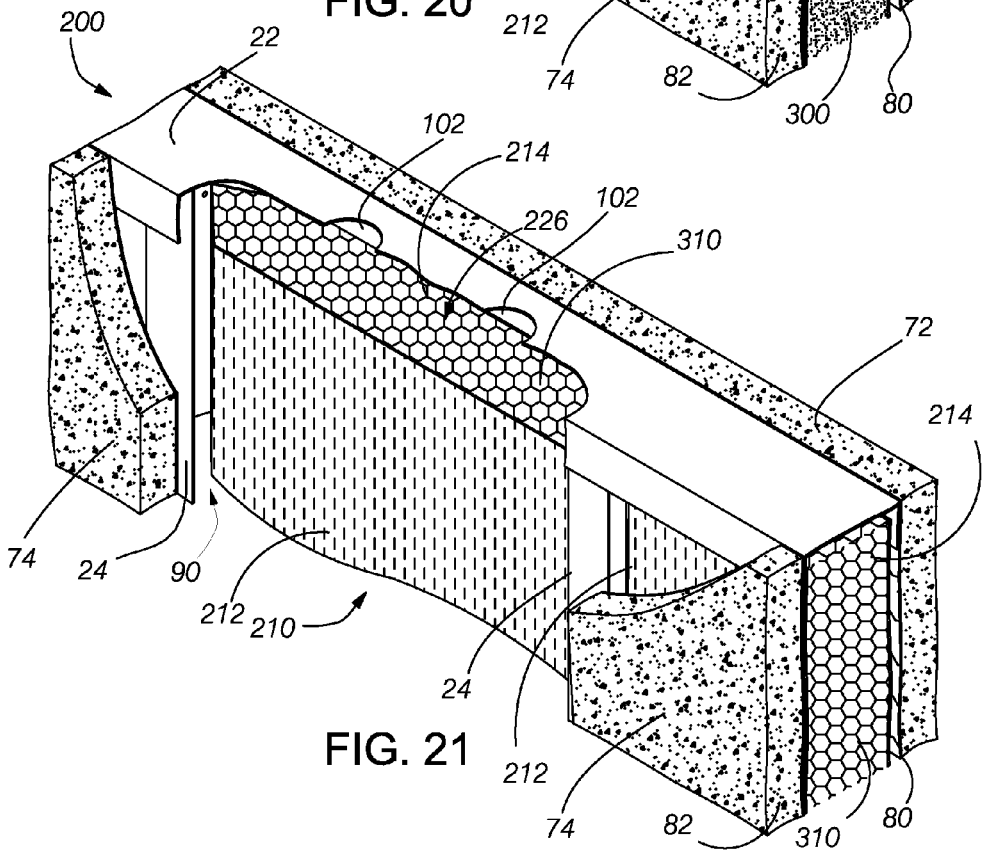
FIG. 21 illustrates a perspective view of the top portion of the wall section similar to the view in FIG. 13 but with the bag-like structure filled with an insulating material such as foam.

In a further embodiment shown in FIG. 20, the bag-like structure 210 is filled with an insulating material 310, such as for example, polyurethane foam insulation, fiberglass insulation, or the like. The insulating material may be added to the bag-like structure in a similar manner to the granulated material directly into the open top 226 before closing the wall structure or through the plurality of holes 102 through the upper horizontal member 22. For example, the insulation may comprise loose blown-in insulation or may comprise expanding foam insulation, which expands to fill the flexible cavity. The closed first vertical side 222, the closed second vertical side 224 and the closed bottom 220 assure that the insulation remains within the bag-like structure to provide the insulating benefits.

As discussed above, the length and width of the single sheet 230 that is formed into the bag-like structure 210 are selected to conform to the height, width and thickness of the wall structure 200. For example, in a wall structure having a cavity 90 with a nominal height of 8 feet and a nominal width of approximately 16 inches between adjacent vertical members 24, the single sheet has an initial length of approximately 16 feet to provide a folded length of approximately 8 feet when the bag-like structure is formed as discussed above.

The width of the single sheet 230 for an application where the bag-like structure 210 is to remain empty is approximately 18 inches to accommodate the width of the cavity and to provide 1 inch along the edges of the folded structure for mounting the reinforcement strips 250 and 260. In particular, when mounted in the cavity, the portions of the bag-like structure having the reinforcement strips are bent to approximately 90 degrees so that the fasteners 290 passing through the mounting holes 270 and 280 are perpendicular to the vertical members. For applications where the bag-like structure is filled with granular material or insulation, length and width of the single sheet are adjusted to compensate for the thickness of the filled bag-like structure. For example, in a wall structure having a cavity with a nominal thickness of 4 inches, the width of the single sheet is advantageously increased by approximately 4 inches so that the first side 212 and the second side 214 can each expand approximately two inches from the closed edges. The overall length of the single sheet may also be adjusted to accommodate the cavity thickness, and the amount of the adjustment may be determined empirically based on the type of filler material in the bag-like structure and how the filler material affects the shape of the lower portion of the bag-like structure.

One skilled in art will appreciate that the foregoing embodiments are illustrative of the present invention. The present invention can be advantageously incorporated into alternative embodiments while remaining within the spirit and scope of the present invention, as defined by the appended claims.

We claim:

1. A wall system comprising:

a lower horizontal member;

an upper horizontal member;

a plurality of spaced apart vertical supports positioned between the lower horizontal member and the upper horizontal member, each vertical support having a thickness between a respective first side and a respective second side;

a first panel mounted to the respective first sides of at least two of the vertical supports and a second panel mounted to the respective second sides of the at least two of the vertical supports to form a cavity bounded by the first panel and the second panel and bounded by the at least two of the vertical supports, at least one of the first panel and the second panel comprising:

a sheet of construction material; and a metallic sheet secured to the sheet of construction material; and a bag-like structure secured within the cavity, the bag-like structure comprising at least one sheet of woven, high tensile strength fiber.

2. The wall system as defined in claim 1, wherein:

the bag-like structure has a first side facing the first panel and a second side facing the second panel, a first closed edge common to the first side and the second side and a second closed edge common to the first side and the second side, a closed bottom and an open top, the bag-like structure having a flexible cavity defined between the first side and the second side; and the bag-like structure is supported within the cavity by securing the first and second sides proximate the first closed edge to a first of the vertical supports that bound the cavity and by securing the first and second sides proximate the second closed edge to a second of the vertical supports that bound the cavity.

3. The wall system of claim 2, wherein the flexible cavity of the bag-like structure is filled with a selected material.

4. The wall system of claim 3, wherein the selected material is a granular material.

5. The wall system of claim 4, wherein the granular material comprises a stony material.

6. The wall system of claim 5, wherein the stony material comprises sand.

7. The wall system as defined in claim 3, wherein the selected material comprises an insulating material.

8. The wall system of claim 7, wherein the insulating material comprises fiberglass.

9. The wall system of claim 7, wherein the insulating material comprises expanding polyurethane foam.

10. The wall system of claim 1, wherein the at least one sheet of woven, high tensile strength fiber comprises woven para-aramid fiber.

11. The wall system of claim 1, wherein:

the metallic sheet comprises a first face and a second face;

the first face of the metallic sheet is secured to the sheet of construction material; and a sheet of self-healing material is positioned on the second face of the metallic sheet.

12. A method of constructing a wall system, comprising:

erecting a plurality of vertical support members between a lower horizontal member and an upper horizontal member to form wall frame having a first side and a second side;

mounting a first panel on a first side of the wall frame and mounting a second panel on a second side of the wall frame to form a plurality of cavities therebetween, at least one of the first panel and the second panel comprising a sheet of construction material and a sheet of metal adhered to the sheet of construction material; and securing a bag-like structure within the cavity, the bag-like structure comprising at least one sheet of woven, high tensile strength fiber, the bag-like structure having a first side facing the first panel and a second side facing the second panel, a first closed edge common to the first side and the second side and a second closed edge common to the first side and the second side, a closed bottom and an open top, the bag-like structure having a flexible cavity defined between the first side and the second side.

13. The method of claim 12, further comprising filling the flexible cavity of the bag-like structure is filled with a selected material.

14. The method of claim 13, wherein the selected material is a granular material.

15. The method of claim 14, wherein the granular material comprises a stony material.

16. The method of claim 15, wherein the stony material comprises sand.

17. The method of claim 13, wherein the selected material comprises an insulating material.

18. The method of claim 17, wherein the insulating material comprises fiberglass.

19. The method of claim 17, wherein the insulating material comprises expanding polyurethane foam.

20. The method of claim 12, wherein the at least one sheet of woven, high tensile strength fiber comprises woven para-aramid fiber.

21. A wall section comprising:

a lower horizontal member;

at least a first vertical member and a second vertical member, each vertical member comprising:

a lower end mounted on the lower horizontal member;

an upper end;

a first side; and a second side;

an upper horizontal member mounted on the upper end of the first vertical member and the upper end of the second vertical member;

a first panel secured to the first side of the first vertical member and to the first side of the second vertical member, and a second panel secured to the second side of the first vertical member and to the second side of the second vertical member, the first panel and the second panel forming a cavity bounded by the lower horizontal member, the upper horizontal member, the first vertical member and the second vertical member, at least one of the first panel and the second panel comprising:

a wallboard sheet; and a thin sheet of high-strength material attached to and covering at least one side of the wallboard sheet; and a bag-like structure secured within the cavity, the bag-like structure comprising at least one sheet of woven, high tensile strength fiber.

* * * * *